US012364339B1

(12) United States Patent
Menna

(10) Patent No.: US 12,364,339 B1
(45) Date of Patent: Jul. 22, 2025

(54) BED PAD SYSTEM

(71) Applicant: Thomas Menna, Johnstown, PA (US)

(72) Inventor: Thomas Menna, Johnstown, PA (US)

( * ) Notice: Subject to any disclaimer, the term of this patent is extended or adjusted under 35 U.S.C. 154(b) by 261 days.

(21) Appl. No.: 18/175,038

(22) Filed: Feb. 27, 2023

(51) Int. Cl.

| | |
|---|---|
| ***A47C 27/00*** | (2006.01) |
| ***A47C 21/04*** | (2006.01) |
| ***A47C 31/10*** | (2006.01) |
| ***A47G 9/04*** | (2006.01) |

(52) U.S. Cl.
CPC ..... *A47C 27/002* (2013.01); *A47C 21/042* (2013.01); *A47C 21/048* (2013.01); *A47C 31/105* (2013.01); *A47G 9/04* (2013.01)

(58) Field of Classification Search
CPC ... A47C 27/001; A47C 31/105; A47C 27/002; A47C 27/18; A47C 19/028; A47C 21/042; A47C 21/048; A47C 27/15; A47C 21/022; A47C 27/148; A47C 27/082; A47G 9/023; A47G 9/0261; A47G 9/02; A47G 9/0207; A47G 9/0246; A47G 9/0215; A47G 9/0238; A47G 9/04
USPC ... 5/691, 486, 502, 482, 501, 497, 513, 500, 5/690, 722
See application file for complete search history.

(56) References Cited

U.S. PATENT DOCUMENTS

| | | | | |
|---|---|---|---|---|
| 4,969,223 | A * | 11/1990 | Yamaguchi | A47C 27/001 5/722 |
| 6,163,907 | A * | 12/2000 | Larson | A47C 21/048 5/691 |
| 6,862,760 | B2 * | 3/2005 | Bradley | A47G 9/023 24/72.5 |
| 6,922,862 | B1 * | 8/2005 | Thompson | A47C 27/005 5/691 |
| 10,321,774 | B2 * | 6/2019 | Sherman | A47C 31/105 |
| 2007/0289069 | A1 * | 12/2007 | Wells | A47C 27/15 5/727 |
| 2016/0192786 | A1 * | 7/2016 | Holbrook | A47C 27/085 5/691 |
| 2018/0000255 | A1 * | 1/2018 | Youngblood | F25B 21/02 |
| 2019/0290013 | A1 * | 9/2019 | Boyd | A47C 27/083 |

FOREIGN PATENT DOCUMENTS

| | | | | |
|---|---|---|---|---|
| KR | 20180000577 U | * | 2/2018 | A47C 27/081 |

* cited by examiner

*Primary Examiner* — Madison Emanski
(74) *Attorney, Agent, or Firm* — John J. Elnitski, Jr.

(57) ABSTRACT

A bed pad system having at least two mattress pads covers to form a larger single mattress pad cover. Each of the mattress pad covers is adapted to individually receive a mattress pad. There is at least one connecting tab extending from each of the mattress pad covers. Each connecting tab from each of the mattress pad covers is aligned on the mattress pad cover to match up with the connecting tab of the other mattress pad cover to form the single larger mattress pad cover from the at least two mattress pads covers.

6 Claims, 4 Drawing Sheets

BED PAD SYSTEM

BACKGROUND

The present invention generally relates to bedding. More specifically, the present invention relates to combining bedding to meet individual needs for varying firmness of a mattress.

After the "honeymoon" period has passed, couples have the need to find a mattress that will meet the needs of both partners. Whether it is a need for a firm mattress due to a bad back or that desire for a soft cozy mattress, couples needs vary widely and individually. One of the partners has had to compromise to meet the needs of the other partner when choosing mattress firmness. The cost of a mattress is expensive, so the mattress is not easily replaced due to cost. There even more expensive split bedding systems on the market but they do not provide a simple or cost effective solution.

It is an object of the present invention to provide combined bedding to meet individual needs for varying firmness of a mattress topper.

SUMMARY

A bed pad system having at least two mattress pads covers to form a larger single mattress pad cover. Each of the mattress pad covers is adapted to individually receive a mattress pad. There is at least one connecting tab extending from each of the mattress pad covers. Each connecting tab from each of the mattress pad covers is aligned on the mattress pad cover to match up with the connecting tab of the other mattress pad cover to form the single larger mattress pad cover from the at least two mattress pads covers.

DETAILED DESCRIPTION

Figure 1:
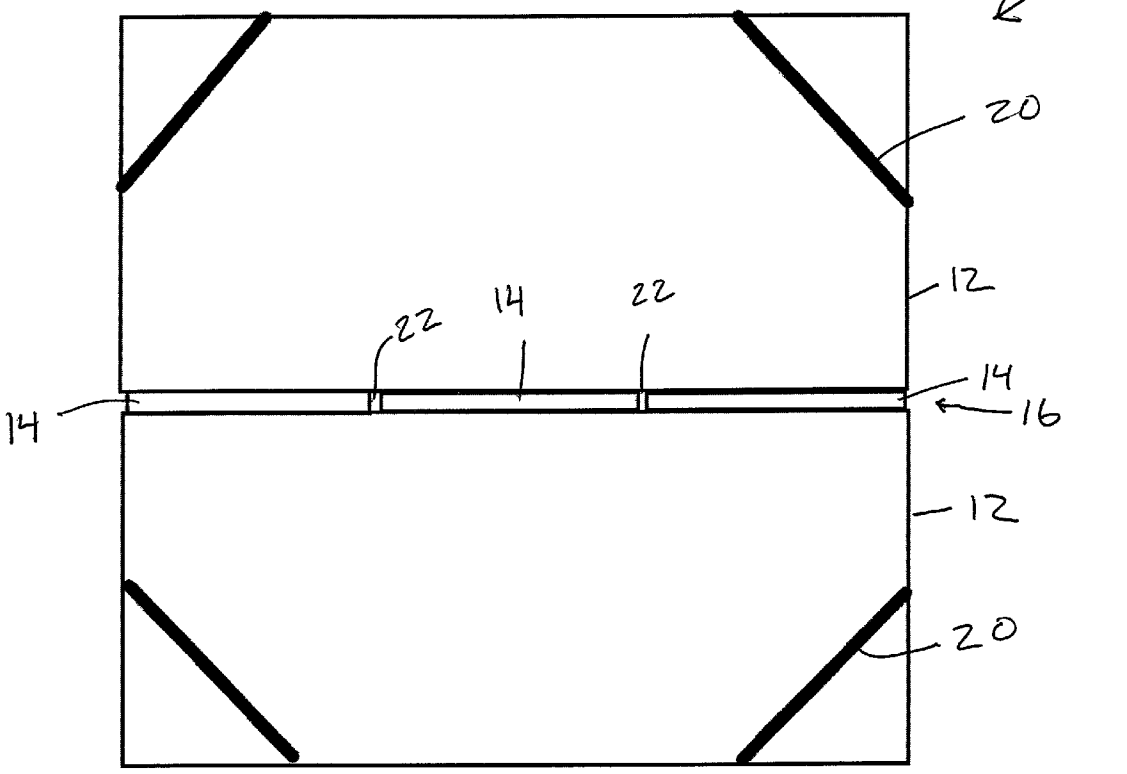
FIG. 1 is a schematic top view of a bed pad system according to the present invention.
Figure 2:
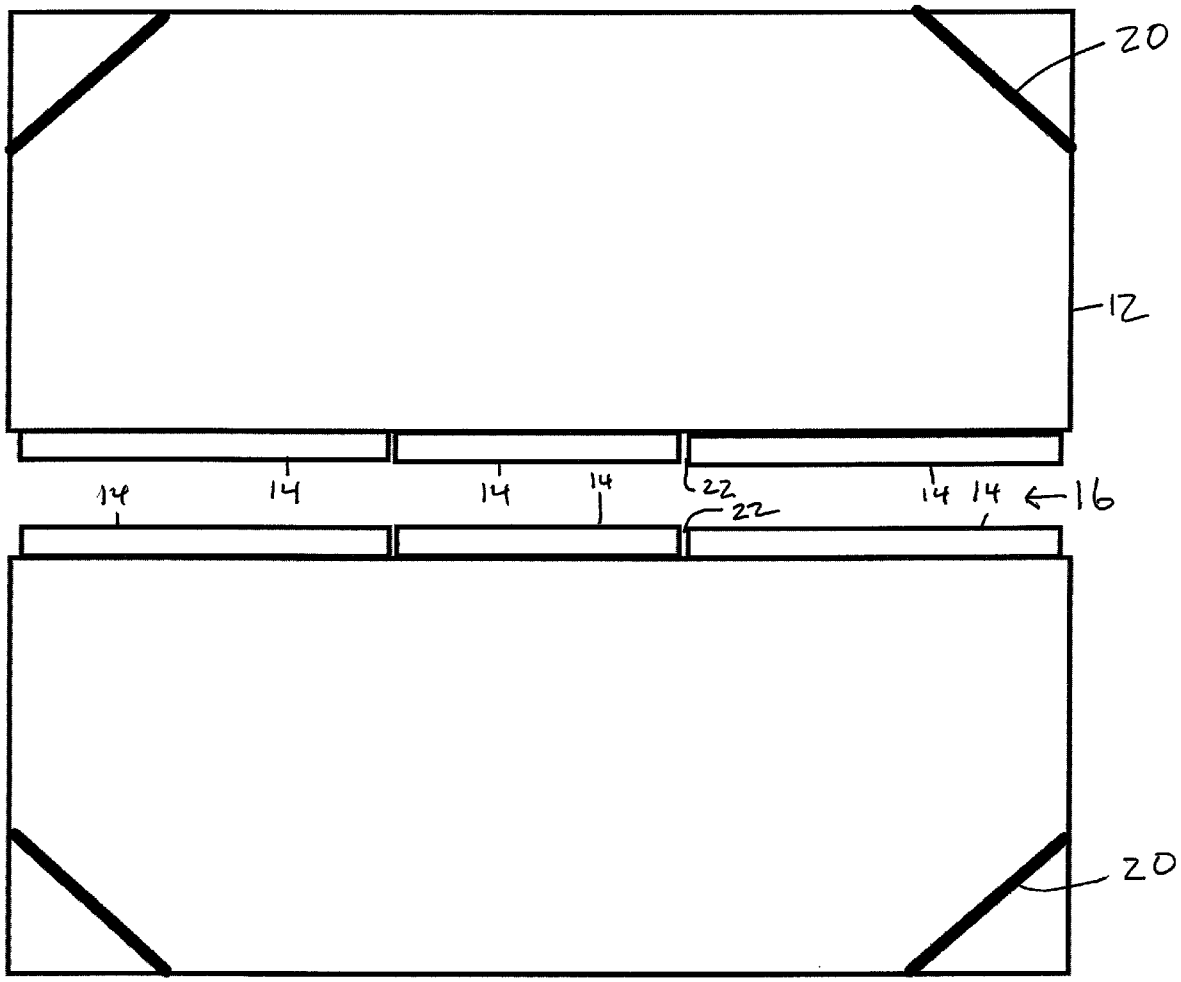
FIG. 2 is a schematic top view of a bed pad system according to the present invention.
Figure 3:
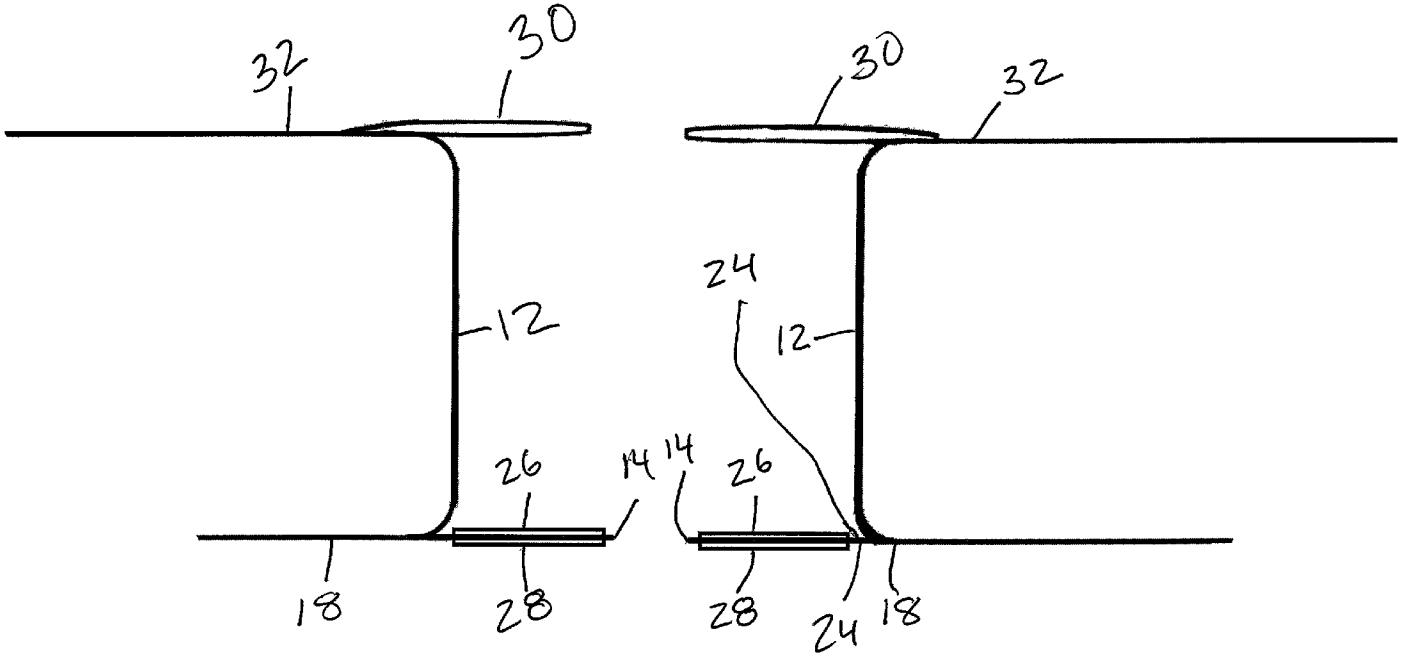
FIG. 3 is a schematic end view of a bed pad system according to the present invention.
Figure 4:
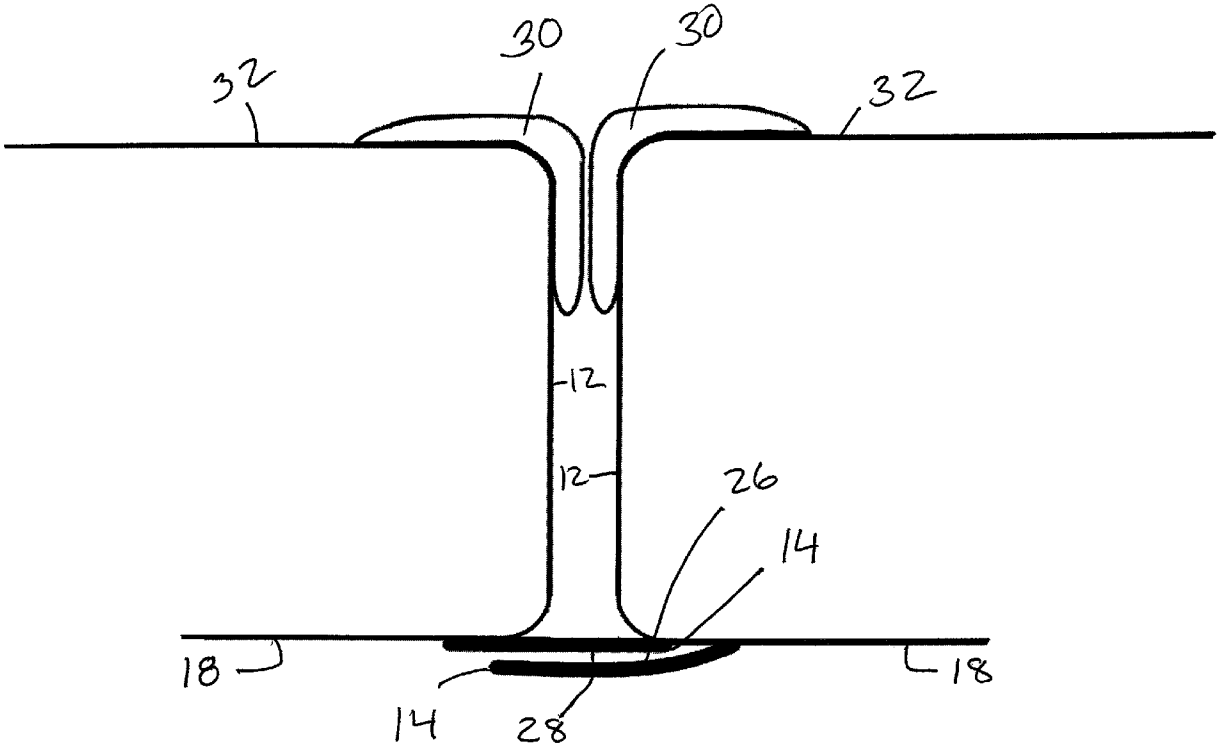
FIG. 4 is a schematic end view of a bed pad system according to the present invention.

FIG. 1 shows a bed pad system 10. The bed pad system includes two mattress pad covers 12. Each mattress pad cover 12 receives a mattress pad within the cover 12. Each mattress pad cover 12 includes connection tabs 14 for interconnecting the mattress pad covers 12 along an adjoining centerline 16. The connecting tabs 14 of one mattress pad cover 12 interconnects with the connecting tabs 14 of the other mattress pad cover 12 to form a larger combined mattress pad cover, as shown in FIGS. 2-4. The connecting tabs 14 extend from the bottom 18 of the mattress pad covers 12. FIG. 3 shows the connecting tabs 14 apart and FIG. 4 shows the connecting tabs 14 on one mattress pad cover 12 attached to the connecting tabs 14 of the other mattress pad cover 12. The combined mattress pad cover accommodates different firmness due to being able to receive different mattress pads in each mattress pad cover 12. The mattress pad covers 12 are sized so that when combined together a combined mattress pad cover fits full, queen, king, or California king sized beds.

The user selects the desired firmness of each mattress pad to be inserted into each mattress pad cover 12. The mattress pad can include different firmness, memory foams, heating and cooling options that are individually controlled to make for the perfect night sleep for users. The mattress pad covers 12 can be of a dual quilted material that provides a gentle transition from one thickness to another thickness of mattress padding. The mattress pad covers 12 allow for a softer pad to be matched with a firmer pad and joined down the centerline 16. FIGS. 1 and 2 also show corner straps 20 to wrap around the corners of a mattress to prevent movement of the combined mattress pad on a mattress. To accommodate many of the adjustable beds on the market, the connecting tabs 14 have splits 22 between the connecting tabs 14 that form gaps. The splits 22 allow for the raising of the head or legs without putting strain on the connecting tabs 14 that would happen if there were no gaps. Also the center connecting tab 14 can be utilized with the top connecting tab 14 and bottom tab 14 folded back, if the end user has a dual adjustable bed.

FIGS. 1-4 envision the use of Velcro on each side 24 of the connecting tabs 14. The Velcro dual sided connecting tabs 14 provide a connection between the mattress pad covers 12 that is non-directional, which simplifies manufacturing and assembly of the two mattress pad covers 12 together. While other fasteners can be used to connect the connecting tabs 14 of the mattress pads covers 12 together, there are benefits of using Velcro. FIG. 3 shows the hoop 26 on one side of the connecting tabs 14 and loop 28 on the other side of the connecting tabs 14. One of the benefits of Velcro used in this way is a universal connection that allows the user not have to purchase a designated "left" or "right" side mattress pad cover 12. With Velcro, all of the mattress pad covers 12 will interlock with each other and can be placed in the appropriate orientation on the bed to meet the needs of the user. Another benefit is that Velcro provides a non-mechanical connection which does not require the use of tools. Use of double sided Velcro or "One-Wrap" allows manufacturing to be simplified into a single manufacturing line fabrication. The use of the One-Wrap Velcro allows for the mattress pad covers 12 to butt join together eliminating a gap between the mattress pad covers 12. FIG. 3 shows a gap filler 30 extending from the top 32 of each mattress pad cover 12. FIG. 4 shows each gap filler 30 folded down into a gap between the mattress pad covers 12. The gap filler 30 runs along the length of each mattress pad cover 12 on the same side as the connecting tabs 14. The gap filler 30 can be made of quilted material or other soft material.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A bed pad system, comprising: a first mattress pad cover adapted to individually receive a first mattress pad; a second mattress pad cover separate from said first mattress pad cover adapted to individually receive a second mattress pad; said first mattress pad cover and said second mattress pad cover are configured to have a separable configuration and a combinable configuration, wherein the combinable configuration forms the bed pad system along a centerline, wherein the bed pad system with first and second mattress pad in the combinable configuration is configured to rest on top of a mattress and is configured to allow a user to lay on the bed pad system; and at least one connecting tab extending from each of said first and second mattress pad covers, each of said at least one connecting tab from each of said first mattress pad cover is aligned on said first mattress pad cover to match up with a respective connecting tab from said second mattress pad cover to combine said first mattress pad cover and said second mattress pad cover from the separable configuration to the combinable configuration to form said bed pad system from said first and second mattress pad covers, wherein said first mattress pad cover and said second mattress pad cover are adapted to receive the respective first and second mattress pads of different firmness levels, such that there is an interchangeable feature of firmness that occurs along said centerline using said at least one connecting tab from each of said first mattress pad cover and said second mattress pad cover.

2. The bed pad system of claim 1, wherein there are at least two connecting tabs extending from each of said first and second mattress pad covers and a gap between each of said at least two connecting tabs.

3. The bed pad system of claim 1, wherein at least one of said first and second mattress pad covers has a gap filler to fill a gap between said first and second mattress pad covers when assembled together.

4. The bed pad system of claim 1, wherein said first and second mattress pad covers have corner straps.

5. The bed pad system of claim 1, wherein said connecting tabs of the first and second mattress covers have fasteners to connect said connecting tabs from one of said mattress pad covers to another of said mattress pad covers.

6. The bed pad system of claim 1, wherein said connecting tabs of the first and second mattress covers have hook material on one side of said connecting tab and loop material on an other side of said connecting tab to connect said connecting tabs from one of said mattress pad covers to another of said mattress pad covers.

* * * * *